United States Patent [19]

Johnston

[11] 4,160,139

[45] Jul. 3, 1979

[54] PRESSURE SENSITIVE SWITCH

[75] Inventor: Samuel A. Johnston, Fontana, Wis.

[73] Assignee: Bunker Ramo Corporation, Oak Brook, Ill.

[21] Appl. No.: 828,622

[22] Filed: Aug. 29, 1977

[51] Int. Cl.[2] ..... N01H 35/38

[52] U.S. Cl. ..... 200/83 N

[58] Field of Search ..... 200/83 S, 83 SA, 83 W, 200/83 N, 83 V, 83 R, 159 B

[56] References Cited

U.S. PATENT DOCUMENTS

| | | | |
|---|---|---|---|
| 2,131,264 | 9/1938 | Benjamin | 200/83 S |
| 2,270,608 | 1/1942 | Sandberg | 200/83 W |
| 2,967,944 | 1/1961 | Lusted | 200/83 N |
| 3,562,456 | 2/1971 | Rogers | 200/83 B |
| 3,743,801 | 7/1973 | Brobeck | 200/83 N |
| 3,814,877 | 6/1974 | Alverez | 200/83 N |
| 4,038,506 | 7/1977 | Filip | 200/83 N |

*Primary Examiner*—Donald O. Woodiel
*Attorney, Agent, or Firm*—William Lohff; F. M. Arbuckle

[57] ABSTRACT

A pressure sensitive switch for indicating when a fluid pressure reaches a predetermined limit includes a housing having a top wall and a dielectric substrate within the housing spaced from the top wall. A metal diaphragm is hermetically bonded to the substrate to form a cavity between the top wall and the diaphragm. The diaphragm includes a major resilient portion which deforms responsive to varying fluid pressures within the cavity. A first contact is fixedly mounted relative to the substrate and a second contact, arranged for movement with the deformable diaphragm, is spaced from the first contact in juxtaposition thereto. When the fluid pressure within the cavity reaches a predetermined limit, the second contact engages the first contact to close the switch. When the fluid pressure is below the predetermined limit, the second contact moves with the diaphragm away from the first contact to open the switch.

Also disclosed is a barometric version wherein the inside of the diaphragm is partially evacuated and atmospheric pressure outside the cavity works against the diaphragm to open and close the switch.

30 Claims, 15 Drawing Figures

PRESSURE SENSITIVE SWITCH

BACKGROUND OF THE INVENTION

The present invention relates to pressure sensitive switches and more particularly to pressure sensitive switches which provide an indication when a fluid pressure reaches a predetermined limit.

There are many applications wherein it is essential that fluid pressure levels be maintained within a predetermined pressure range. The fluid pressure must not decrease below a minimum limit nor increase beyond a maximum limit. The oil pressure of an automobile is a good example of such an application.

In order to monitor fluid pressures and to provide an indication when the fluid pressures are either below or above a safe operating range, pressure sensitive switches have been devised. Such prior pressure sensitive switches have incorporated a number of movable parts which lend to their complexity and unreliable operation over an extended period of time. Such switches may become unreliable because the number of movable parts may lock in either an open or closed position. The cumulative effect is that prior switches suffer eventual degraded accuracy and potential non-operability. Also, prior art pressure sensitive switches have not responded to the need of sensing multiple pressure while maintaining simplicity of design and reliable operation.

It is therefore a general object of the present invention to provide a new and improved pressure sensitive switch.

It is another object of the present invention to provide a new and improved pressure sensitive switch for detecting when a fluid pressure reaches a predetermined limit.

It is a still further object of the present invention to provide a new and improved pressure sensitive switch which affords extremely high levels of reliability even after extended periods between switch closures.

It is a still further object of the present invention to provide a new and improved pressure sensitive switch which provides sensitive and highly reliable operation notwithstanding adverse environmental conditions such as vibration, shock, and wide temperature excursions and which is capable of sensing a multiplicity of pressures.

SUMMARY OF THE INVENTION

The invention provides a pressure sensitive switch including an enclosure having a top wall, a substrate of dielectric material within the enclosure and spaced from the top wall, and a diaphragm mounted on the substrate and forming a first cavity with the top wall, the diaphragm having a resilient surface portion for moving with respect to the substrate responsive to variations in fluid pressure within the cavity. The pressure sensitive switch also includes a first contact fixedly mounted relative to the substrate, and a second contact arranged for movement with the diaphragm and for engaging and disengaging the first contact responsive to the varying fluid pressures and the diaphragm movement.

BRIEF DESCRIPTION OF THE DRAWINGS

The features of the present invention which are believed to be novel are set forth with particularlity in the appended claims. The invention, together with further objects and advantages thereof, may best be understood by reference to the following description taken in connection with the accompanying drawings, in the several figures of which like reference numerals identify like elements, and in which:

DESCRIPTION OF THE PREFERRED EMBODIMENTS

Figure 2:
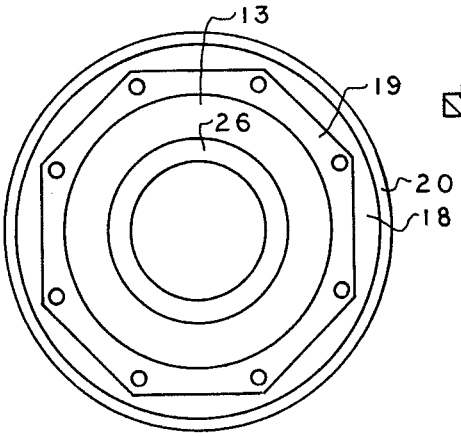
FIG. 2 is a top view of the pressure sensitive switch of FIG. 1 with the housing cover removed.
Figure 1:
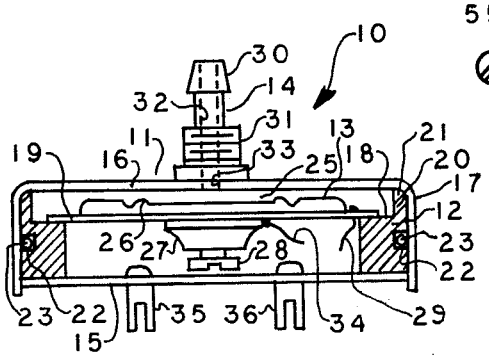
FIG. 1 is a side view, partly in cross-section, of a pressure sensitive switch embodying the present invention.
Figure 3:
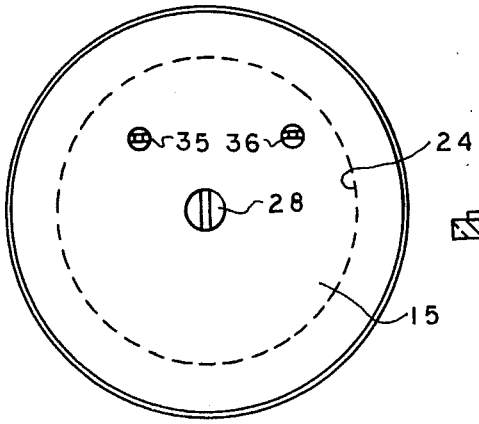
FIG. 3 is a bottom plan view of the pressure sensitive switch of FIG. 2.

Referring now to FIGS. 1 through 3, the pressure sensitive switch 10 there shown which embodies the present invention includes a housing means 11, a spacer 12, diaphragm 13, a pressure port 14, and a circuit card 15. Housing 11 includes a metal cap or casing 16 which is cylindrically shaped having a top wall and an annular sidewall 17. The housing cap 16 is opened at one end wherein the circuit card 15 is located.

The spacer 12 is substantially ring-shaped having a major inner wall 24 and is dimensioned for being tightly received within the metal cap 16. The spacer 12 includes a horizontal shelf 18 for supporting a dielectric substrate 19. The spacer 12 also includes a vertical extension 20 which is contoured at its upper corner 21 in a shape corresponding to the inner dimension of the metal cap 16. An annular groove 22 is provided in the spacer 12 for receiving a suitable resilient seal member, such as O-ring 23, so that the outer surface of the spacer 12 and the inner surface of the metal cap 16 are sealed together.

The substrate 19 is greater in dimension than the aperture defined by the inner wall 24 of the ring-shaped spacer 12. Substrate 19 thus overlaps the aperture of spacer 12 and is hermetically bonded to shoulder 18 of spacer 12. With the substrate 19 so mounted on shoulder 18 of spacer 12, a cavity 25 is formed between diaphragm 13 and the top of the metal cap 16.

The diaphragm 13 is formed from metal and includes a substantial surface area which deforms responsive to fluid pressures within cavity 25. To enable diaphragm 13 to deform, the diaphragm is provided with at least one annular corrugation 26.

Also mounted on the substrate on the side opposite cavity 25 is a conductive threaded member 27. The threaded member 27 has a central inner threaded bore which receives a suitably threaded conductive screw 28. The screw 28 terminates in a tip end within the diaphragm 25 which includes a precious metal contact forming the fixed contact of the pressure sensitive switch. This structure and an alternative embodiment will be described in greater detail hereinafter.

Mounted on top of housing cap 16 is a pressure port 14 which includes a termination end 30 of the type which is suitable for communicating with tubing of resilient material. The port 14 has a lower portion 31 which is externally threaded to facilitate mounting of the pressure sensitive switch 10. The pressure port 14 includes a central bore 32 which communicates with an aperture 33 within the metal cap 16 to provide fluid access to cavity 25. Thus, with fluid access being provided to cavity 25, the fluid pressure to be monitored is provided access to cavity 25 for deforming the metal diaphragm 13.

The circuit card 15 preferably comprises a second substrate of dielectric material and is mounted on spacer 12 to define a bottom wall of the housing at the open end of the cap 16. It includes external contacts 35 and 36. The circuit card 15 may include suitable circuit means to be described hereinafter for providing an indication when the pressure within cavity 25 reaches a predetermined limit.

Figure 4:
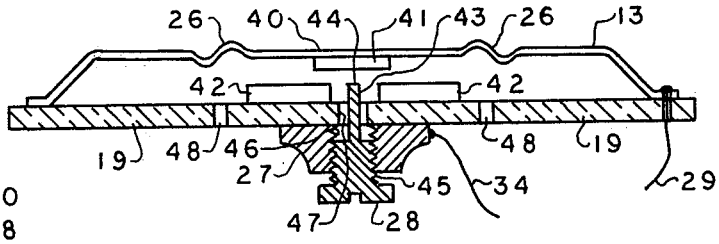
FIG. 4 is a cross-sectional view of a switching element which may be utilized in practicing the present invention.

FIG. 4 shows a cross-sectional view of a preferred pressure sensitive switching element which may be utilized in the pressure sensitive switch of FIG. 1. It includes the substrate 19, a metal diaphragm 13, the threaded conductive block 27, and the threaded conductive screw member 28. The corrugations 26 allow surface portion 40 of diaphragm 13 to be resilient so that it may move with respect to the substrate 19 responsive to variations in fluid pressure applied to it within cavity 25 (FIG. 1). The diaghragm 13 carries on its inner surface a precious metal contact 41 which is bonded for electrical conductivity with the diaphragm 13. Contact 41 may for example be bonded on diaphragm 13 with conductive epoxy. Preferably, it is located on the inner surface of diaphragm 13 in the central portion thereof, which comprises the area of maximum deflection of diaphragm 13.

A stop means 42 is mounted on substrate 19 within the diaphragm to limit diaphragm movement towards substrate 19. Stop means 42 may be a dielectric block of material which is bonded to the substrate 19. It is dimensioned so that the extension 43 of threaded member 28 extends into diaphragm 13 only slightly beyond the top surface of the block so that the diaphragm contact 41 will be free to make contact and engage the contact tip 44 of extension 43.

The contact tip 44 preferably formed from precious metal is supported within the diaphragm and spaced apart from the movable contact 41 by the external thread 45 of conductive threaded screw 28. Threaded screw 28 is threaded into the threaded bore 46 of threaded member 27. The extension 43 which carries contact tip 44 extends through a central aperture 47 of substrate 19. The predetermined level of pressure necessary to cause the fixed contact 44 and the movable contact 41 to engage may be varied by simply turning threaded screw 28 clockwise or counterclockwise as requirements dictate. Also, the predetermined level of pressure may be varied by altering the spring rates of diaphragm 13. The substrate 19 includes vent holes 48 to permit the pressure within cavity 25 (FIG. 1) to work against atmospheric pressure.

The contacts are preferably connected to an electrical circuit for indicating contact engagement and disengagement by conductors 29 and 34. Conductor 29 passes through substrate 19 and makes electrical contact with diaphragm 13. Because the diaphragm 13, contact 41, and the epoxy bonding contact 41 to the diaphragm are all conductive, conductor 29 makes electrical connection to the movable contact 41. Conductor 34 is soldered or otherwise conductively bonded to the conductive threaded member 27 for making electrical connection with fixed contact 44 through threaded member 27 and screw member 28.

In operation, the fluid, having the pressure to be monitored, is introduced into cavity 25 through the pressure port 14. As the pressure within cavity 25 varies, the resilient surface portion 40 of diaphragm 13 moves towards and away from substrate 19. When the pressure within cavity 25 exceeds the predetermined limit, the movable contact 41 will engage the fixed contact 44 to close the pressure switch. When the pressure within cavity 25 decreases to a value less than the predetermined limit, the contacts 41 and 44 will once again disengage and the switch will open.

Figure 5:
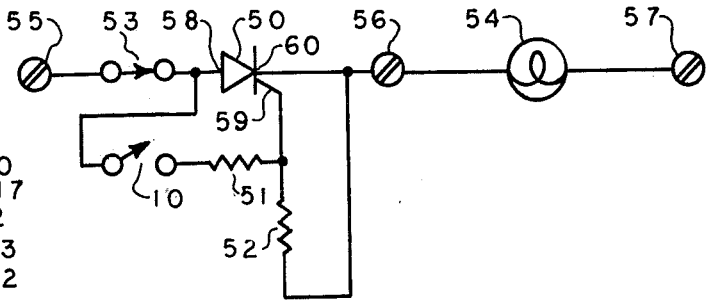
FIG. 5 is a schematic circuit diagram of a circuit means which may be utilized in practicing the present invention.

FIG. 5 shows a suitable circuit means which may be utilized in connection with the switch element of FIG. 4 for providing an indication of contact engagement and disengagement. Preferably, the circuit of FIG. 5 is incorporated onto the circuit card 15 of the pressure sensitive switch 10. The circuit includes a silicon controlled rectifier (SCR) 50, resistors 51 and 52, a normally closed reset switch 53, a warning device such as an incandescent light bulb 54 and terminals 55, 56 and 57. Terminal 55 is connected to the normally closed reset switch 53. The normally closed reset switch 53 is connected to the anode 58 of SCR 50 and to the pressure sensitive switch 10. Resistor 51 is connected between the pressure sensitive switch 10 and the control gate 59 of SCR 50. Resistor 52 is connected between the junction of resistor 51 and control gate 59 and the cathode 60 of SCR 50. The cathode 60 is also connected to terminal 56. The warning device 54 is coupled between terminals 56 and 57. To complete the circuit, terminal 55 is connected to a positive voltage source and terminal 57 is connected to a negative voltage source.

In operation, when the fluid pressure within cavity 25 is below the predetermined limit, the switch contacts 44 and 41 will be disengaged so that no current will flow through the SCR 50 and the warning device 54. If the pressure within cavity 25 exceeds the predetermined limit, the pressure sensitive switch 10 will close with the contacts 41 and 44 engaging. The SCR 50 will then be biased on and the warning device will be energized. The warning device will stay energized even if the pressure switch contacts disengage until the normally closed reset switch 53 is manually opened to interrupt current flow through the circuit.

Figure 6:
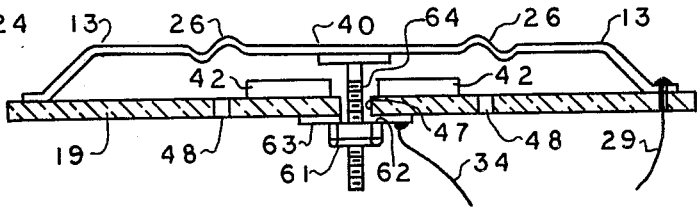
FIG. 6 is a cross-sectional view of another switching element embodying the present invention.

FIG. 6 shows a pressure sensitive switch element in accordance with the present invention which is normally closed and opens when the pressure within cavity 25 (FIG. 1) exceeds the predetermined limit. It includes substrate 19, metal diaphragm 13, fixed contact 63, movable contact 62 and stop means 42. The diaphragm 13 includes the corrugations 26 and the resilient surface portion 40.

The movable contact 62 of the switching element of FIG. 6 is mounted on a threaded member 64 which is conductively bonded to the inner wall of diaphragm 13 and extends through aperture 47 of substrate 19. A nut member 61 is threaded onto threaded member 64 and includes a precious metal contact on its top surface.

The fixed contact 63 includes a precious metal coating which is deposited or bonded onto substrate 19. The contact 63 is provided in juxtaposition to movable contact 62 and about aperture 47. As a result, the fixed contact 63 and movable contact 62 are arranged for engagement and disengagement with diaphragm movement. The fixed contact 63 and the movable contact 62 may be coupled to circuit means by conductors 34 and 29 respectively.

In operation, when the pressure within cavity 25 exceeds the predetermined limit, the resilient surface portion 40 of diaphragm 13 distorts inwardly towards substrate 19 causing the contacts 63 and 62 to disengage. When the pressure is reduced below the predetermined limit, the resilient surface portion 40 returns to its original position causing the contacts 63 and 62 to once again engage.

Figure 7:
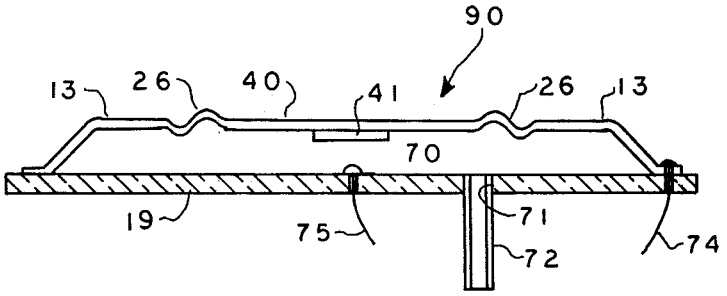
FIG. 7 is a cross-sectional view of another switching element which may be utilized in practicing the present invention to form a barometric pressure sensitive switch.
Figure 8:
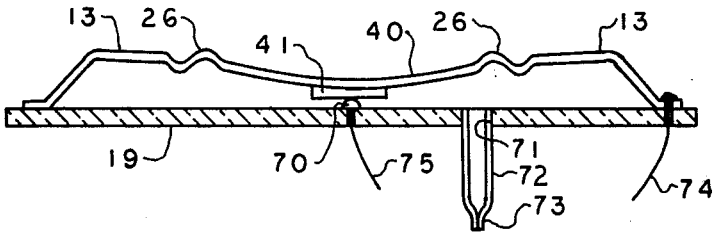
FIG. 8 is a cross-sectional view of the switch element of FIG. 7 showing details of its operation.

FIGS. 7 and 8 show a further embodiment of a pressure switching element in accordance with the present invention which may be utilized as a barometric pressure switch 90. It includes the substrate 19, the diaphragm 13 hermetically sealed to substrate 19 and the precious metal contact 41 conductively bonded to the inner surface of diaphragm 13 in the area of the resilient surface portion 40. It also includes a precious metal fixed contact 70 on substrate 19 within the diaphragm in juxtaposition to contact 41. The fixed contact 70 and movable contact 41 may be connected to circuit means to be described hereinafter by conductors 75 and 74 respectively. The substrate 19 includes an aperture 71 and a sealable port 72 which communicates with the aperture 71 and the inside of diaphragm 13. The substrate, however, doesn't include any vent holes as shown with respect to the previous embodiments.

During the final assembly of the barometric switch of FIG. 7, the cavity within diaphragm 13 is partially evacuated by drawing air out of sealable port 72 until contacts 70 and 41 just engage. Thereafter, port 72 is sealed as at 73 by heating (as illustrated) or by clamping or the like.

With this configuration, the diaphragm 13 will deform responsive to variations in atmospheric pressure because the inside of diaphragm 13 is now sealed from the outside atmospheric pressure. When the atmospheric pressure decreases to a level below the evacuated pressure within the diaphragm 13, the contacts 41 and 70 will disengage. When the atmospheric pressure increases beyond the level of pressure within diaphragm 13, the contacts 70 and 41 will once again engage. Thus, the switching element of FIGS. 7 and 8 serves as a barometric pressure switch. Of course, since atmospheric pressure is being monitored, the pressure port 30 (FIG. 1) is left open to the air so that the atmospheric pressure may work against diaphragm 13.

Figure 9:
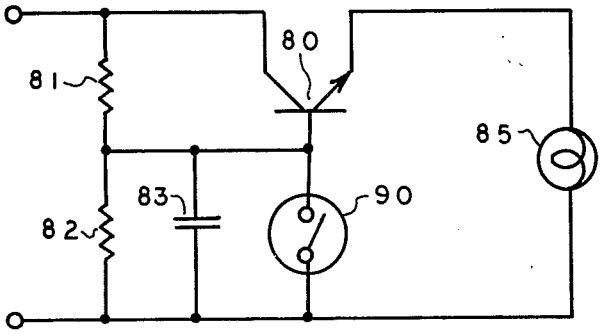
FIG. 9 is a schematic circuit diagram of a circuit means which may be utilized in conjunction with the switch element of FIGS. 7 and 8 in practicing the present invention.

FIG. 9 shows a suitable circuit means which may be utilized in connection with the barometric pressure switch of FIGS. 7 and 8. It includes a transistor 80, resistors 81 and 82, a capacitor 83, the barometric switch 90, and an external load 85 which may be an incandescent light bulb or the like.

When the barometric pressure is below the pressure within diaphragm 13, the pressure switch 90 will be opened. Transistor 80 will thus be forward biased and current will flow through transistor 80 and the indicator 85. When the barometric pressure increases beyond the pressure within diaphragm 13, the pressure switch 90 will close by virtue of contacts 41 and 70 engaging. As a result, the bias to transistor 80 will be removed and current will no longer flow through the transistor 80 and into the external load indicating lamp 85. When the atmospheric pressure once again returns to a level below the pressure within cavity 13, the pressure switch 90 will once again open and current will once again flow through the external load indicating lamp.

Figure 10:
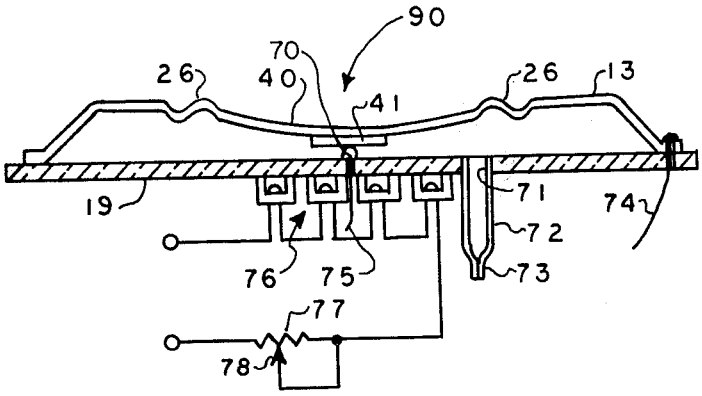
FIG. 10 is a cross-sectional view of the barometric sensitive switch of FIG. 7 further including hysteresis means in accordance with a further aspect of the present invention.

Referring now to FIG. 10, FIG. 10 shows the barometric sensitive switch of FIG. 7 further including hysteresis means in accordance with a further aspect of the present invention. The hysteresis means includes a multi-pole electromagnet 76 and a current adjustment means comprising a variable resistor 77. The electromagnet 76 and variable resistor 77 are connectable within a circuit, such as the circuit shown in FIG. 11 so that once movble contact 41 contacts fixed contact 70, the contacts will not disengage until the magnetic forces provided by electromagnet 76 are overcome.

Electromagnet 76 is supported on substrate 19 on the side of substrate 19 opposite diaphragm 13. The variable resistor 77 is connected in series with the electromagnet 76 and includes a wiper element 78. As the wiper element 78 wipes across the resistor 77, the current through the electromagnet varies to render the required force for separating the contacts selectively adjustable.

Figure 11:
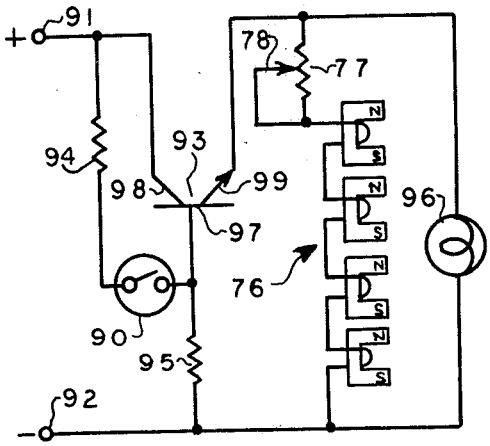
FIG. 11 is a schematic circuit diagram which may be utilized in conjunction with the switch of FIG. 10.
Figure 13:
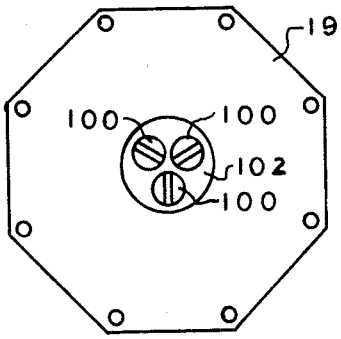
FIG. 13 is a bottom plan view of the switching element of FIG. 12.

FIG. 11 shows a circuit diagram of a circuit means which may be utilized in conjunction with the switch of FIG. 10. It includes a pair of terminals 91 and 92 which are adapted for connection to a source of operating potential. The circuit of FIG. 11 also includes a transistor 93, fixed resistors 94 and 95, the variable resistor 77, the electromagnet 76, indicating means such as incandescent light bulb 96, and the switching element 90.

Resistor 94 is coupled between terminal 91 and switching element 90. Resistor 95 is coupled at one end to both the base 97 of transistor 93 and the switching element 90. At its other end, resistor 95 is coupled to terminal 92. The collector 98 of transistor 93 is coupled to the terminal 91 and its emitter 99 is coupled to the light source 96 and the variable resistor 77. The variable resistor 77 and electromagnet 76 are coupled in parallel with light source 96 across emitter 99 of transistor 93 and terminal 92.

In operation, when the pressure within the cavity external to diaphragm 13 is greater than the pressure within diaphragm 13, contacts 41 and 70 engage to thus close the switching element 90. As a result, current will flow through transistor 93. As a further result, current will flow through the variable resistor 77 and the multipole electromagnet 76. The electromagnet 76 is so arranged on substrate 19 so that its magnetic field, when energized, attracts the diaphragm 13. Thus, as a result, when engagement between contacts 41 and 70 is established, there is a resulting magnetic force applied to diaphragm 13 which increases the contact pressure causing a clean contact "make". As the pressure on the outside of the diaphragm 13 is reduced, the magnetic attraction force as well as the diaphragm spring force must be overcome before the contacts 71 and 70 will disengage. This makes for a clean "break" when that force is overcome. The hysteresis may be controlled by controlling the current through electromagent 76 with proper adjustment of wiper 78 of variable resistor 77.

Figure 12:
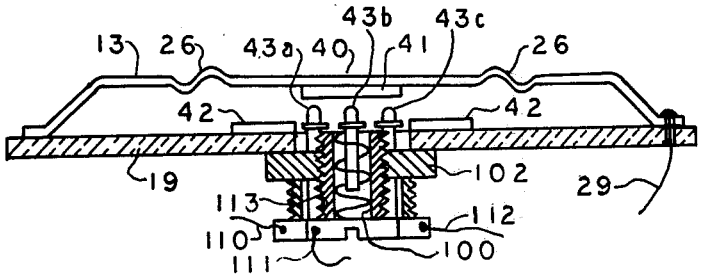
FIG. 12 is a cross-sectional view of a multiple pressure sensing switching element in accordance with the present invention.
Figure 14:
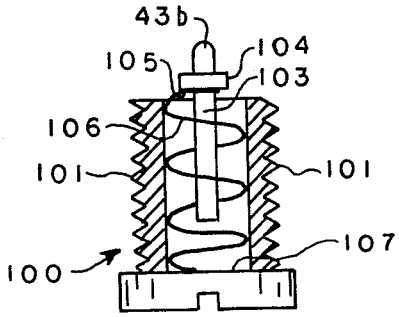
FIG. 14 is an enlarged cross-sectional view of a portion of the switching element of FIG. 12.

Referring now to FIG. 12, it shows a switching element which is capable of detecting a multiplicity of pressure levels. Specifically, three different pressure levels may be detected. The switching element of FIG. 12 includes the substrate 19, the diaphragm 13, the movable contact 41 conductively bonded to the resilient surface portion 40 of diaphragm 13, stop means 42, and three fixed contacts 43*a*, 43*b* and 43*c*. Each of the fixed contacts 43*a*, 43*b* and 43*c* is movable after it is engaged by the movable contact 41 within a cylindrical housing such as housing 100 associated with contact 43*b*. A cross-sectional view of contact 43*b* and its associated housing 100 is shown in FIG. 14. The cylindrical housing includes external threads which are threadable into a threaded member 102 carried by substrate 19. The contact 43*b* includes a shaft extension 103 which extends partially into the cylindrical housing 100. The shaft 103 and contact 43*b* are separated by an annular flange 104 which provides a bottom shoulder 105. The contact 43*b* is spring loaded within the cylindrical housing by a spring 106 which is coaxial about shaft 103 and communicates at one end with shoulder 105 and at the other end with the bottom 107 of cylindrical housing 100. Spring 106 is coiled such that when contact 43*b* is disengaged from movable contact 41, contact 43*b* extends a fixed distance above the bottom 107 of cylindrical housing 100. The spacing between each of the contacts 43*a* through 43*c* from the movable contact 41 is adjustable by turning the cylindrical members within their respective threaded apertures either clockwise or counterclockwise as requirements dictate. As a result, three different pressures may be sensed.

Preferably, the threaded cylindrical members are constructed from conductive material as are the springs, shafts, and annular flanges separating the contacts from the shaft extensions. As a result, the switching element of FIG. 12 may be connected within a suitable indicating circuit by conductors 110 through 112 being soldered or otherwise conductively bonded to the cylindrical members and a conductor 29 which is connected to diaphragm 13.

Figure 15:
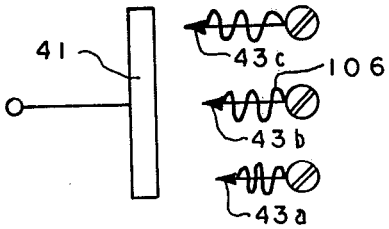
FIG. 15 is a schematic representation illustrating the operation of the switching element of FIG. 12.

FIG. 15 illustrates schematically the operation of the switching element of FIG. 12 wherein each of the contacts 43*a*, 43*b* and 43*c* is spaced by a different amount from the movable contact 41. As the pressure external to the diaphragm within cavity 25 (FIG. 1) increases, contact 43*c* will first be engaged by movable contact 41. As the movable contact 41 proceeds to move further to the right as illustrated in FIG. 15, contact 43*c* will move with movable contact 41 against its spring pressure. When a second pressure is reached, contact 43*b* will be engaged by movable contact 41 and it will move to the right against its spring as the pressure increases. When the pressure increases to a third pressure, contact 43*a* will be engaged by movable contact 41.

The bottom plan view of switching element of FIG. 12 shows that the threaded cylinders 100 may be threaded into three separate apertures such as 113 which are contained within a disc 102 formed from dielectric material. As a result, the three cylindrical members 100 are insulated from one another and the contacts which they are associated with are independently spaced from the movable contact 41.

From the foregoing, it can be appreciated that the invention as represented by the various embodiments shown and described herein provides an improved pressure sensitive switch. Because the main movement element of the switch is a resilient metal, it will provide sensitive and reliable operation notwithstanding detrimental external environmental variations such as shock, vibration, and temperature extremes. Also, because the diaphragm is the only moving component part, the moving component parts are greatly minimized to further promote reliable operation.

Pressure sensitive switches of the type disclosed herein have been constructed and have been found to operate to indicate pressues in the neighborhood of 7.5 torrs (1 torr is equal to 1 milimeter of mercury) with a repeatability better than ±0.5 torr. In the embodiments of FIGS. 4 and 6, wherein the gap between the contacts is adjustable, the pressure limit at which the switch acts may be varied. This makes the pressure sensitive switches of the present invention adaptable for a wide variety of applications.

While a particular embodiment of the present invention has been shown and described, it will be obvious to those skilled in the art that various changes and modifications may be made without departing from the invention in its broader aspects. The aim in the appended claims is to cover all such changes and modifications as may fall within the true spirit and scope of the invention.

I claim:

1. A pressure sensitive switch comprising:

a housing including a cap having a top wall and a continuous side wall, a spacer tightly disposed within said housing and including a support surface, a dielectric substrate secured to said support surface of said spacer, a metal diaphragm mounted about its periphery on said substrate and forming a first cavity with said top wall of said cap and a second cavity with said substrate, said first cavity communicating with a source of fluid pressure, said metal diaphragm having a large resilient surface portion movable toward and away from said substrate in response to variations in fluid pressure within said first cavity, a first contact supported by said substrate in a preselected position relative to said diaphragm, and a second contact supported by said diaphragm and arranged for movement with said diaphragm, said second contact engaging and disengaging said first contact in response to variations in fluid pressure within said first cavity.

2. A pressure sensitive switch as defined in claim 1 wherein said second contact is mounted on said diaphragm.

3. A pressure sensitive switch as defined in claim 1 wherein said second contact is mounted on said diaphragm within said second cavity.

4. A pressure sensitive switch as defined in claim 3 wherein said first contact is normally disengaged from said second contact and wherein said second contact engages said first contact when the fluid pressure within said cavity exceeds a predetermined limit.

5. A pressure sensitive switch as defined in claim 4 further including contact spacing adjustment means for rendering the gap between said first and second contacts selectably variable to thereby provide means for altering said predetermined limit.

6. A pressure sensitive switch as defined in claim 5 wherein said contact spacing adjustment means comprises an aperture within said substrate, a first member secured to said substrate and having a threaded aperture aligned with said substrate aperture, and a rototable member having a first end portion extending through said aperture into said diaphragm and carrying said first contact and a second end portion having an external thread communicating with said threaded aperture.

7. A pressure sensitive switch as defined in claim 1 further comprising stop means secured to said diaphragm for limiting the movement of said diaphragm in the direction towards said substrate.

8. A pressure sensitive switch as defined in claim 1 wherein said first contact is secured to said substrate.

9. A pressure sensitive switch as defined in claim 1 wherein said first contact is secured to said substrate on the side of said substrate opposite said diaphragm.

10. A pressure sensitive switch as defined in claim 9 wherein said first and second contacts are normally engaged and wherein said first and second contacts disengage when the fluid pressure within said first cavity exceeds a predetermined limit.

11. A pressure sensitive switch as defined in claim 10 wherein said second contact is external of said second cavity and in juxtaposition with said first contact.

12. A pressure sensitive switch as defined in claim 11 further comprising a first member and a second member, and wherein said substrate includes an aperture in close proximity to said first contact, said first member having a first end secured to said diaphragm and a second end extending through said substrate aperture, and said second member being secured on said second end of said first member and carrying said second contact.

13. A pressure sensitive switch as defined in claim 12 wherein said first and second members are threaded and rotatable with respect to each other to provide means for varying the gap between said first and second contacts for altering said predetermined limit.

14. A pressure sensitive switch as defined in claim 1 wherein said diaphragm and said substrate form a sealed second cavity.

15. A pressure sensitive switch as defined in claim 14 wherein said first contact is secured to said substrate within said second cavity.

16. A pressure sensitive switch as defined in claim 15 wherein said second contact is mounted on said diaphragm within said second cavity.

17. A pressure sensitive switch as defined in claim 16 wherein said second cavity is at least partially evacuated such that said first and second contacts engage to thereby cause a predetermined differential pressure between said first and second cavities to thereafter cause said first and second contacts to engage and disengage in response to variations in differential pressure about said predetermined differential pressure.

18. A pressure sensitive switch as defined in claim 17 further comprising a sealable port and wherein said substrate includes an aperture communicating with said second cavity and said port to provide means for evacuating said second cavity and thereafter sealing said cavity.

19. A pressure sensitive switch as defined in claim 1 wherein said top wall includes a port whereby said first cavity communicates with said source of fluid pressure.

20. A pressure sensitive switch as defined in claim 1 further including a second dielectric substrate defining a bottom wall of said housing.

21. A pressure sensitive switch as defined in claim 20 further including circuit means on said second dielectric substrate coupled to said first and second contacts and responsive to the engagement and disengagement of said first and second contacts for providing an indication of first and second contact engagement and disengagement.

22. A pressure sensitive switch comprising:

a housing including a cap having a top wall and a continuous side wall;

a spacer tightly disposed within said housing and including a support surface;

a dielectric substrate secured to said support surface of said spacer;

a metal diaphragm mounted about its periphery on said substrate and forming a first cavity with said top wall of said cap and a second cavity with said substrate;

said first cavity communicating with a source of fluid pressure;

said metal diaphragm having a large resilient surface portion movable toward and away from said substrate in response to variations in fluid pressure within said first cavity;

a first contact supported by said substrate in a preselected position relative to said diaphragm;

a second contact supported by said diaphragm and arranged for movement with said diaphragm;

said second contact engaging and disengaging said first contact in response to variations in fluid pressure within said first cavity, said second contact engaging said first contact when the pressure differential between said cavities is greater than a predetermined limit, said second contact disengaging said first contact when the pressure differential between said cavities decreases beyond said predetermined limit plus a fixed factor; and hysteresis means for maintaining the engagement of said contacts until the pressure differential decreases beyond said predetermined limit plus said fixed factor.

23. A pressure sensitve switch as defined in claim 22 wherein said hysteresis means comprises an electromagnet mounted on said substrate on the side of said substrate opposite said diaphragm.

24. A pressure sensitive switch as defined in claim 23 further including circuit means including said electromagnet for applying energizing current to said electromagnet upon engagement of said first and second contacts.

25. A pressure sensitive switch as defined in claim 24 wherein said circuit means further includes current adjustment means coupled in series within said electromagnet for providing adjustment of the magnitude of said energizing current.

26. A pressure sensitive switch as defined in claim 25 wherein said current adjustment means comprises a variable impedance.

27. A pressure sensitive switch for sensing a plurality of pressures comprising:

a housing including a cap having a top wall and a continuous sidewall;

a spacer tightly disposed within said housing and including a support surface;

a dielectric substrate secured to said support surface of said spacer;

a metal diaphragm mounted about its periphery on said substrate and forming a first cavity with said top wall of said cap and a second cavity with said substrate said first cavity communicating with a source of fluid pressure;

said metal diaphragm having a large resilient surface portion movable toward and away from said substrate in response to variations in fluid pressure within said first cavity;

a plurality of first contacts supported by said substrate in a preselected position relative to said diaphragm; and a second contact supported by said diaphragm and arranged for movement with said diaphragm;

said second contact engaging and disengaging said first contacts in response to varying fluid pressures within said cavity.

28. A pressure sensitive switch as defined in claim 27 further including first contact adjustment means for adjusting the spacing between each of said first contacts and said second contact independently so that said second contact engages each of said first contacts at independently adjustable fluid pressure levels.

29. A pressure sensitive switch as defined in claim 28 wherein each of said first contacts is mounted for moving with said second contact after engagement with said second contact.

30. A pressure sensitive switch as defined in claim 29 wherein each of said first contacts is spring loaded to a fixed position and mounted for movement against said spring.

* * * * *